United States Patent [19]

Plesko

[11] Patent Number: 4,534,459

[45] Date of Patent: Aug. 13, 1985

[54] LOW POWER COIN ROUTING GATE APPARATUS

[75] Inventor: George A. Plesko, Graterford, Pa.

[73] Assignee: Mars Incorporated, McLean, Va.

[21] Appl. No.: 585,252

[22] Filed: Mar. 1, 1984

[51] Int. Cl.[3] ..... G07F 9/04

[52] U.S. Cl. ..... 194/1 D; 194/1 K

[58] Field of Search ..... 194/1 C, 1 K, 1 D, 102, 194/DIG. 27, DIG. 28, DIG. 29, 103, 99, 100 R, 100 A, 97 R

[56] References Cited

U.S. PATENT DOCUMENTS 4,257,512 3/1981 Hooker ..... 194/100 A

OTHER PUBLICATIONS

Photographs (4), Nalco Coin Acceptor.

*Primary Examiner*—Stanley H. Tollberg

*Attorney, Agent, or Firm*—Davis, Hoxie, Faithfull & Hapgood

[57] ABSTRACT

A coin routing gate for accepting coins in a coin handling mechanism requires only a low power electromagnet to hold the gate in an accept position. In the absence of power to the electromagnet, the gate passively rejects coins by gravity alone. The gate is arranged to accomplish minimization of the required holding force to minimize electrical power requirements thereby making the device suitable for low electrical power contexts such as coin operated telephone service.

9 Claims, 4 Drawing Figures

LOW POWER COIN ROUTING GATE APPARATUS

BACKGROUND OF THE INVENTION

1. Technical Field

The present invention relates to a coin routing gate for directing coins within coin handling mechanisms for coin operated devices such as product vending machines, amusement devices, patron admission gates, TV, and other goods and services. The present invention is particularly useful for coin handling apparatus where minimal electrical power is a requirement as is the case for coin operated telephone service wherein electrical energy beyond that required for communication signals must be held to a minimum.

2. Background Art

Coin operated devices commonly employ coin handling mechanisms which accept those coins which pass validation and denomination testing, and reject those which fail. Credit is given for the values of those coins accepted and when the credit equals the value set for the transaction, a signal is issued which initiates the vending, service, or other function. Accepted coins may be assorted for storage according to denomination for dispensing as change or directed to a general cash box. The inserted coins are returned if unacceptable, or if the transaction is canceled or cannot be completed.

Typically, coin routing gates are employed to direct and separate coins to achieve the foregoing functions. For example, such gates may be used to separate acceptable from unacceptable coins, to direct acceptable coins to coin storage tubes according to coin denomination for change making, or to a cash box for unassorted storage.

Once an acceptable coin is recognized and the decision to issue credit for the value of the coin has been made, it is the accept gate which functions to route the coin for coin storage. If the decision is made not to issue credit for the inserted coin or other item, such as a token, it is the accept gate which functions to reject the inserted item for return to the user.

In the past, solenoids have been used as one technique for providing the force necessary to actuate coin gates and spring biasing has been used to restore the gates to their initial positions. Such solenoids which are still widely used in vending machines may have power requirements on the order of 30 watts. This power requirement has been met by connecting the solenoids to a source of line voltage or to a stepdown transformer providing the power at a lower voltage. In either case, the electrical shock hazard implicit in such a high power requirement must be avoided by adequate electrical isolation which adds complexity and cost to the machine.

British Application No. 0235712, assigned to the assignee of the present application, described an improved coin routing device. According to that application, a coin routing device comprises a coin routing member which is selectively movable for controlling the path of a coin. The passage of a control current through a conductor causes the coin routing member to move with respect to a magnet. The device is preferably operated by passing the control current through the conductor in a first direction to move the coin routing member from a first position to a second position and passing the control current through the conductor in the opposite direction to return the coin routing member to its first position.

A recently developed coin acceptor, the Electronic CS 1000, manufactured by NALO GmbH & Co. of West Germany makes use of a small electromagnet to generate the holding force for a pivoting coin routing member located in the path of falling coins. However, in that device the coin routing member is not arranged as is the coin routing gate of the present invention.

DISCLOSURE OF INVENTION

The present invention relates to a moveable coin routing gate such as an accept gate which requires very little electrical power to operate. The gate comprises a pivoted member, part of which forms a portion of a track along which coins roll. When the pivoted member is held in a first position, coins roll from the track, onto and across the gate, and along one passage. The pivoted member is held against pivoting as a coin rolls across it by a low power electromagnet which is energized when it is desired to have the coin continue along the passage. When the electromagnet is not energized, the weight of the coin causes the gate member to pivot to a second position, allowing the coin to fall from the track to another passage or to a return chute. The power required for routing coins using such as gate is low because the electromagnet does no kinetic work, but merely keeps a ferromagnetic piece fast to the pole faces of the electromagnet under conditions of little or no air gap. The pivoted member constitues a lever which pivots at a fulcrum. By adjusting the relative lever arms, a mechanical advantage is acheived further reducing the power necessary to counterbalance the weight of a coin rolling acros the part of the pivoted member forming part of the coin track. Also, the pivoted gate is preferably counterweighted to balance a portion of the weight of any coin which rolls onto the portion of the track defined by the pivoted member. Consequently, the electromagnet must supply only that small force which when added to the weight force of the counterweight and multiplied by the mechanical advantage provided by the lever arrangement of the pivoted member exceeds the effect of the coin's weight. In accordance with the present invention, the power required to hold the gate in the first position is less than 30 milliwatts, or less than one thousandth that now commonly required by solenoids commonly used to control coin routing gates.

According to the present invention, the pivoted gate member is moveable between two positions. In the initial or first position, the gate member forms a portion of the track along which coins will roll. In the second position, the gate member has pivoted in the fashion of a trap door through which a coin falls instead of continuing to roll along the track. The falling coin may intercept a further track for a new routing or fall into a coin storage tube or may be allowed to continue downward through a coin return chute. The gate member has a first portion near one end which forms part of the coin track when the gate is in the first position. The gate member is provided with a pivot axis which may take the form of an axle pin. Where the gate is used as an accept gate, the end opposite the first portion of the gate member is preferably provided with a counterweight. This counterweight is preferably selected so that even very light unacceptable coins will cause the gate to pivot and thus be rejected, but must be selected so that the weight of the lightest coin in the set of acceptable denomination coins will cause the gate to pivot. This opposite end or second portion also is or includes a ferromagnetic piece and alternatively may itself serve as the counterweight. In the first position, the ferromagnetic piece comes to rest against the pole faces of the electromagnet with little or no air gap. In the preferred embodiment, seating adjustment means are included to insure this condiiton.

When the electromagnet is energized, the holding force of the electromagnet when added to the force of the counterweight and multiplied by the mechanical advantage resulting from the lever arrangement exceeds the effect of the weight of the heaviest coin in the set of acceptable denomination coins as it rolls along the track and across the first portion of the gate member. When the electromagnet is not energized, the weight of the lightest coin of the set is sufficient to overbalance the counterweight and the gate member pivots to divert the coin.

The force required to hold the gate is minimal for coins rolling along a sloping track as compared with the holding force required to hold a gate against the impact force of a coin striking a gate which is expected to change the direction of a moving coin or to intercept a falling coin. The power required to hold a ferromagnetic piece in essentially gap-free contact with the end face of an electromagnet's pole pieces and against its initial withdrawal in a direction parallel with the direction of the strongest electromagnetic field lines from the pole pieces to the ferromagnetic piece is also minimal. Greater magnetic force is required to hold it against lateral sliding withdrawal transverse to the strongest field lines and, of course, far greater magnetic force is required to attract a ferromagnetic piece across an air gap than is required to hold the piece in place against the pole faces. Greater magnetic force is required to hold a gate which intercepts falling coins or which must deflect moving coins due to the high impact forces generated in such arrangements. The minimization of holding force is important to the goal of minimizing electrical power requirements in accordance with the present invention, and the present arrangement goes a long way towards meeting this goal.

In the preferred embodiment described below, the invention is used as an accept gate in a device such as a pay telephone for actively accepting coins without physical movement of the accept gate and for passively rejecting coins. In this context, "actively" means requiring electrical power and "passively" means not requiring electrical power for operation of the accept gate. Genuine coins, such as foreign coins, not belonging to the acceptable coin set consisting of those coin demonimations which are to be accepted, as well as non-coin items, such as slugs or counterfeit coins, are to be rejected as are all coins inserted during power interruptions. These criteria are satisfied by the acceptance of a coin only when an accept signal is received for that coin from the output of the validation and acceptance testing portion of the coin handling mechanism and passive rejection of all coins or items attempting to traverse the gate in the absence of an accept signal. The accept signal energizes the electromagnet to hold the gate in the first or initial position for acceptance. When no accept signal is applied, the weight of the coin to be rejected is adequate to move the gate to the reject or second position where the rejected coin falls from the gate. Then, the counterweight restores the gate to its first position. Thus, electrical power is not required for doing any mechanical or kinetic work. Power is required only to hold the gate in the accept position during active acceptance. A gate according to the present invention can handle a set of U.S. coins including the 5-,10- and 25-cents coins and the comtemporary dollar coin at a power level of 30 mW.

In addition to the advantages of using the present invention in the context of low power applications, such as where it is desired to operate using the low phoneline power available for a telephone, low power operation allows the use of a simple and inexpensive drive circuit, avoids the need for an isolation transformer for electrical shock protection, and speeds the acceptance of coins since no mechanism movement is required to accept a coin. The device enjoys the desirable simplicity of having but one moving part which moves only for rejection and which employs gravity for both its movement to the reject position and its restoration to the accept position.

Figure 1:
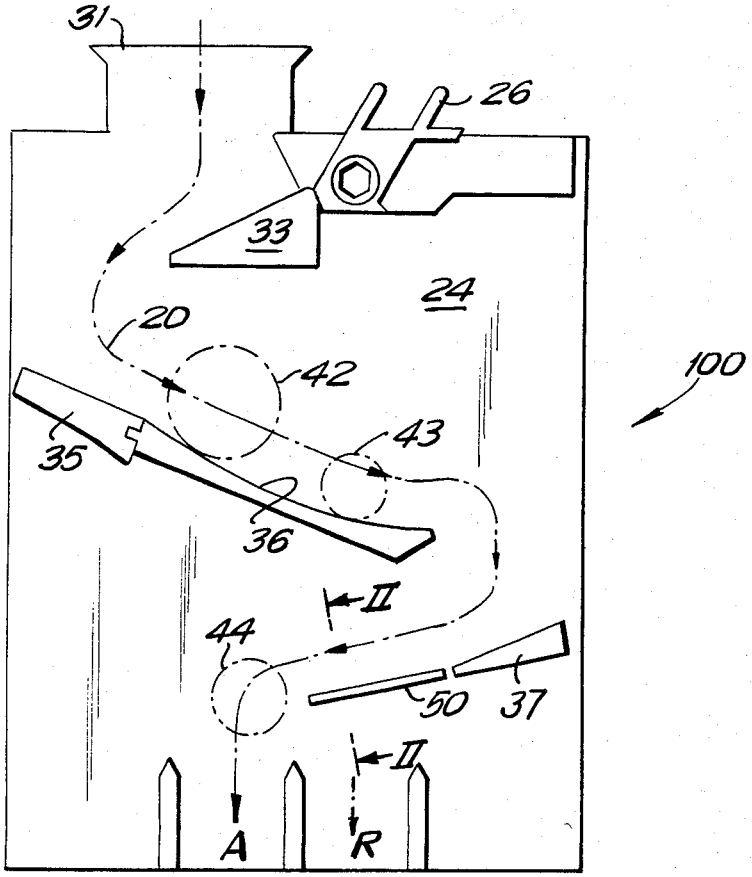
FIG. 1 is a simplified illustration showing the positioning of a coin routing gate according to the present invention used as an accept gate in a coin handling mechanism.

The drawings are representational in that they are intended to illustrate the present invention in easily understood form. Actual shapes and dimensions may differ because of the constraints of space available in complex coin handling apparatus. Further, much of the coin handling apparatus unnecessary to an understanding of the present invention has been simplified or eliminated in these drawings to avoid obscuring the invention.

DESCRIPTION OF THE PREFERRED EMBODIMENT

Coin handling mechanisms generally are designed to accept only genuine coins of one or more predetermined denominations or tokens sold to operate the mechanism. Rejected are non-genuine coins, genuine coins not within the predetermined denominations, or genuine coins of other countries. Genuine coins of a proper denomination may also be rejected if bent, deformed, of alloy contents used in prior years, or when the vending machine contains insufficient coins for change making, is empty of product, or without electrical power. Throughout this specification the term "coin" is used to encompass all of the above items. The coin is acceptable or not according to the decision made by aspects of the coin handling mechanism not of interest here.

The drawings illustrate a coin routing gate 50 according to the present invention employed as an accept gate in a coin handling mechanism 100. In this employment, the gate is used to route accepted coins to appropriate storage or to reject and return unaccepted coins. Other employments of a coin routing gate according to the present invention include, for example, routing coins to be assorted according to denomination into coin storage tubes, and routing coins to a cash box when the coin storage tubes are full.

Since coin handling mechanisms suitable to employ the coin routing gate of the present invention are described in detail in U.S. Pat. Nos. 3,870,137, 3,844,297, and 4,106,610 all assigned to the assignee of the present invention, the coin handling mechanism 100 shown in connection with the present specification is shown in greatly simplified form. Coins inserted into a coin slot of the telephone or vending machine are introduced into a coin receiving cup 31 of the coin handling mechanism 100. The coin intercepts coin track portion 33 which dissipates some of the kinetic energy of the edgewise falling coin. The coin proceeds along a generalized path shown in dashed lines 20 to a second track portion 35 which further dissipates energy to then allow the coin to roll smoothly on edge along an evaluation track portion 36 past a group of sensors 42, 43 which in conjunction with electronic circuitry evaluate the coin for authenticity and denomination with the result being the generation of an accept or reject signal appropriate for the coin. The coin leaves the end of evaluation track portion 36 and falls to a track portion 37 which further dissipates kinetic energy of the coin so that it will be rolling rather than bouncing as it reaches an accept gate 50. Preferably, the energy dissipating track portions 33, 35 and 37 are of the very hard type described in U.S. Pat. No. 3,944,038 assigned to the present invention.

After leaving track portion 37, the coin rolls onto the accept gate 50 according to the present invention which remains in place to allow an accepted coin to roll along the gate 50 to continue along accept path "A" or pivots to allow a rejected coin to fall down reject path "R", all in accordance with the accept or reject signal generated by the electronic evaluation circuitry associated with sensors 42, 43. Details of sensors 42, 43 and associated circuitry suitable for use with the gate 50 are shown in U.S. application No. 585,253 filed on even date herewith and assigned to the assignee of the present invention. Any senor and associated circuit arrangement for generating an accept signal may be used.

The coin paths just described occur along track portions 33, 35, 36, 37 and 50 located between generally parallel walls 22, 24, of the mechanism 100. The walls are separated by a distance greater than the thickness of the thickest acceptable coin of the set. For clarity, one of these walls (22) is removed in FIG. 1 to reveal the serveral track portions. Coin jams, caused by an inappropriately thick coin or item, or by bent coins, are cleared in conventional fashion by manual movement of a coin return lever 26 which separates the walls 22, 24 to allow whatever is in the coin path to fall freely to the coin return. The user also can move the coin return lever 26 to cause return of inserted coins if the user decides to cancel the transaction prior to acceptance of the coin.

Figure 2:
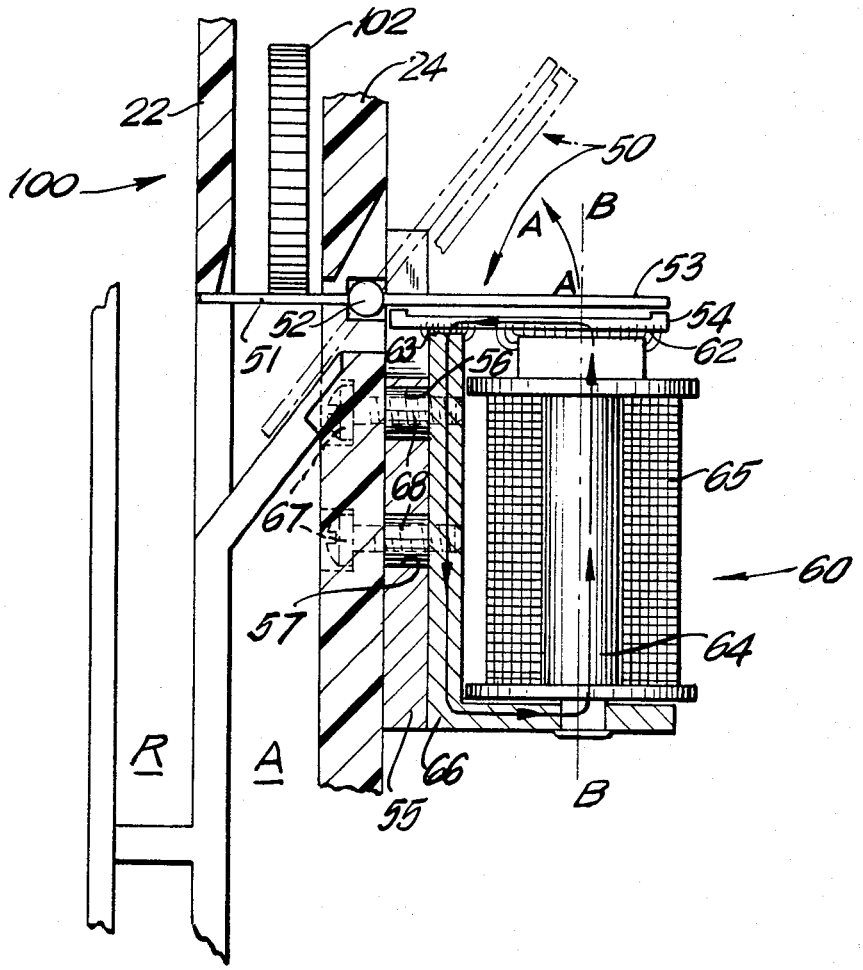
FIG. 2 is a simplified partial section taken along II—II of FIG. 1 showing details of the pivotal mounting of the coin routing gate of FIG. 1 in relation to the coin passageway and the electromagnet.

The operation of accept gate 50 is more clearly shown in FIG. 2. Gate 50 comprises a pivotable piece having a first portion 51 which, in the initial or accept positon, forms a portion of the floor of the coin track along which a coin 102 rolls. A medial pivot axle 52 is between the first portion 51 and a second portion 53 to which a ferromagnetic counterweight 54 is affixed. The ferromagnetic counterweight rests against pole faces 62 and 63 of an electromagnet 60 having a core 64 and a coil 65. As shown in FIG. 2, the core 64 is riveted to iron frame 66 which is an integral part of the electromagnet 60. The frame 66 is mounted using screws 67 and spacer blocks 68.

In the absence of an accept signal, the electromagnet 60 is not energized. The weight on gate portion 51 of the lightest coin of the acceptable set of coins is sufficient to overbalance the counterweight 54 and to tip the gate 50 to the reject position shown in dotted lines in FIG. 2. The rejected coin then falls past the tipped gate 50 and into a reject path "R". Once the rejected coins has left the gate 50 the counterweight 54 causes the gate to pivot back to the initial or accept position shown by solid lines in FIG. 2. In the presence of an accept signal the coil 65 of the electromagnet is energized. The magnetic forces exerted by the electromagnet poles 62, 63 upon the ferromagnetic counterweight 54 is sufficient to hold the gate 50 in the accept position as the heaviest coin of the acceptable set rolls on the first portion 51 of the gate 50 which, when so held, forms a portion of the coin track for accepted coins.

The gate 50 may be of any suitable material including steel, aluminum, or a structural plastic. The ferromagnetic counterweight 54 can be of any low retentivity ferromagnetic material such as soft iron. Although the magnetic and counterweight functions are shown combined into one piece, the functions can be separated into a ferromagnetic piece and separate weight pieces which together equal the predetermined counterweight. Alternatively, the end portion of gate 50 may be made from ferromagnetic material and serve both functions. A suitable low electrical power electromagnet for the gate shown when used in connection with a set of U.S. coins including the 5-, 10-, and 25-cents coins and the contemporary dollar coin is rated at 2.4 volts DC at 24 mA and 100 ohm DC resistance. Such a magnet is available from Kogyosha Co., Ltd., Tokyo Japan. It will be known to the man skilled in the ar that the holding force of an electromagnet is determined by factors such as the material and geometry of its core, the number of turns in its exciting coil, the current passed through the exciting coil and similar factors. Any electromagnet capable of generating sufficient holding force for the particular coin set and design of coin routing gate may be used.

Figure 3:
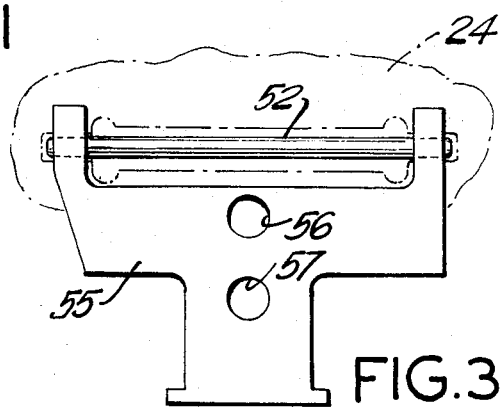
FIG. 3 illustrates a seating adjustment bracket for the coin routing gate of FIG. 1.

No power is required to reject a coin and to return the gate to the accept position. The power required to accept a coin is only that necessary to establish a small holding force to add to the counterweight force. The electrical power required for that small force is minimized by the gap-free contact of the ferromagnetic piece 54 with the pole faces 62 and 63. In the preferred embodiment, a seating adjustment means, such as seating adjustment bracket 55 shown in FIG. 3, is provided. The simple bracket 55 includes holes 56, 57 through which mounting screws are screwed into sidewall 24. By adjusting the screws, it is possible to insure that ferromagnetic piece 54 properly seats itself with little or no air gap on the pole faces 62, 63 when accept gate 50 is in its first or accept position. Other seating adjustment means are contemplated by the present invention. For example, rather than the bracket shown in FIG. 3, the medial pivot axle 52 may be otherwise supported and adjustability may be achieved by loosely rivoting one end of the ferromagnetic piece 54 to the second portion 53 of gate 50 and mounting the other end of ferromagnetic piece 54 in a hole on the second portion 53 so that the ferromagnetic piece 54 does not rotate in the plane of the pole faces 62, 63 but can move slightly in a direction perpendicular to that plane to achieve proper seating.

Also, the electrical power requirement is minimized by the fact that the initial movement of separation of the piece 54 from the pole faces 62 and 63 in a direction substantially perpendicular to the plane defined by the faces of the pole faces 62 and 63 and parallel the strongest field lines from electromagnet 60 to ferromagnetic piece 54. This separation is illustrated in FIG. 2 which shows that the initial motion of separation along line A—A is parallel the line B—B. The force exerted on the gate 50 by an accepted coin is merely the coin weight as it rolls on the gate. The kinetic energy of the coin is largely dissipated by track elements ahead of the gate 50. The net result is operation with very low electrical power.

Figure 4:
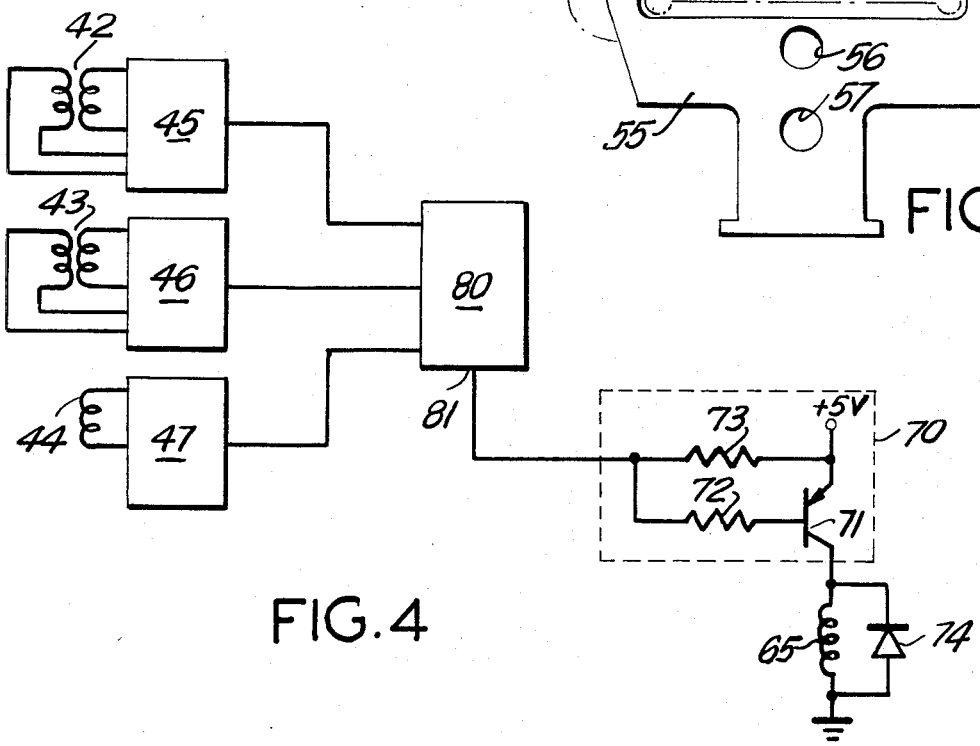
FIG. 4 illustrates drive circuitry suitable for control of the coin routing gate of FIG. 1.

The achievement of such low power operation allows for simplification and cost savings in the design of the drive circuitry used to drive or energize the small electromagnet 60 of the gate 50. FIG. 4 is a block diagram showing one suitable drive circuit 70 for controlling the energization of the coil 65 of the gate electromagnet 60. Drive circuit 70 includes a switching transistor 71 connected to resistors 72 and 73, and a supply of +5 volts. Drive circuit 70 is connected to the parallel combination of the coil 65 and a diode 74. The resistors 72 and 73 are also connected to a control output 81 of a microprocessor 80 which controls whether or not a drive current is provided to the coil 65, that is, whether to accept or to reject a coin. Typical components and values are:

Diode 74 1N4148
Microprocessor 80 80C39
Resistors 72, 73 1.5k, 100k
Transistor 71 2N4356.

The circuit of FIG. 4 also shows sensors 42–44 with their associated sensor circuits 45–47 connected to the microprocessor 80. Sensors 42, 43 in conjunction with sensor circuits 45, 46 and microprocessor 80 test a coin and determine whether or not to accept the coin. Sensor 44 is used to monitor whether a coin is proceeding properly through the coin mechanism 100. U.S. Application Ser. No. 585,253 filed on even date herewith and assigned to the assignee of the present invention shows details of suitable sensors 42–44 and their associated sensor circuits 45–47 for used with a gate according to the present invention. While FIG. 1 shows one arrangement of an accept gate 50 along a coin path 20, other arrangements are contemplated. For example, accept gate 50 could be placed right at the end of coin track portion 36.

I claim:

1. A coin routing gate for selectively routing coins including a lightest and a heaviest acceptable coin in a coin handling mechanism comprising a gate member pivotally mounted in the proximity of a coin track along which coins roll edgewise, the gate member having first and second portions and a medial axis about which the gate member pivots between a first position wherein the first portion forms a part of the coin track and a second position wherein the coin track is interrupted, the second portion serving in the absence of a downward force on the first portion of the gate member exceeding a predetermined force to counterbalance the gate into the first position, the second portion including a magnetically attractable region, a low power, selectively energizable, electromagnet having a pole face in close proximity to the magnetically attractable region when the gate is in the first position, whereby when the electromagnet is not energized and the weight of a coin inserted in the coin handling mechanism produces a downward force on the first portion exceeding the predetermined force, the gate pivots into the second position to thereby prevent the coin from continuing along the coin track, and when the electromagnet is selectively energized, the electromagnet provides magnetic force sufficient to hold the magnetically attractive region to sustain the gate in the first position thereby allowing the coin to roll along the first portion of the gate.

2. A coin routing gate for passively rejecting unaccepted coins and for selectively accepting coins including a lightest and a heaviest acceptable coin in a coin handling mechanism, the coin gate comprising a gate member pivotally mounted in the proximity of a coin passageway along which coins will roll on their edges on a coin track, the gate member in a first position directing accepted coins further along the coin track and in a second position diverting rejected coins, the gate member having first and second portions and a medial axis about which the gate member pivots between the first and second positions, the first portion forming a part of the coin track and the second portion serving in the absence of a downward force on the first portion of the gate member exceeding a predetermined force to counterbalance the gate into the first position, the second portion including a magnetically attractable region, a selectively energizable electromagnet having pole faces in close proximity to the magnetically attractable region when the gate is in the first position, the region being magnetically held in close proximity to the pole faces when the electromagnet is energized, means selectively to energize the electromagnet only when a coin inserted in the coin handling mechanism is to be accepted, to hold the gate in the first position, and selectively not to energize the electromagnet when the coin is to be rejected allowing the weight of the rejeted coin to pivot the gate to the second position to divert the rejected coin from continuing along the coin track, the pivoting of the gate to divert the rejected coin causing the magnetically attractable region to move away from the pole face in a direction initially substantially perpendicular to the plane of the pole faces.

3. The coin routing gate of claim 1 or 2 wherein the lightest acceptable coin will cause pivoting of the gate member in the absence of energization of the electromagnet, and when energized, the electromagnet provided a holding force which when added to a counterbalance force produced by the second portion results in a sun of forces sufficient to prevent the gate from pivoting as the heaviest acceptable coin rolls on the first portion.

4. The coin routing gate of claim 3 wherein the electromagnet is selectively energized by a drive circuit controlled by a logic circuit.

5. The coin routing gate of claim 4 wherein the logic circuit includes a microprocessor.

6. The coin routing gate of claim 1 or 2 wherein the second portion includes a ferromagnetic piece which serves as a counterbalance weight and as the magnetically attractable region.

7. The coin routing gate of claim 1 or 2 wherein the coin track includes means to dissipate kinetic energy of coins approaching the gate member to limit the motion of the coins on the gate member to rolling.

8. The coin routing gate of claim 1 or 2 further comprising a seating adjustment means for adjusting the gate member so that the air gap between the electromagnet and the magnetically attractable region of the gate is substantially eliminated when the gate is in its first position.

9. A coin routing gate comprising a pivotally mounted gate member which has a first position from which it can be deflected by a moving coin to a second position to permit the coin to take one path, and an electrically energisable retaining means which is selectively operable to retain the gate member in its first position to cause the coin to take another path, characterized in that the gate member when in its first position forms an extension of a coin track on which coins roll on edge, the gate member is deflectable from the first position to the second position by the weight of a coin, and the gate member when retained by the retaining means in its first position is not deflected by the weight of a coin so that the coin rolls across the gate member and continues to travel on the coin track.

* * * * *

UNITED STATES PATENT AND TRADEMARK OFFICE

CERTIFICATE OF CORRECTION

PATENT NO. : 4,534,459

DATED : August 13, 1985

INVENTOR(S) : George A. Plesko

It is certified that error appears in the above-identified patent and that said Letters Patent is hereby corrected as shown below:

List of OTHER PUBLICATIONS, "Nalco" should read -- NALO--.

Col. 5, line 28, "assigned to the present invention" should read --assigned to the assignee of the present invention--.

Col. 6, line 36, "ar" should read --art--.

Col. 8, lines 56 & 57, "provided" should read --provides--.

Signed and Sealed this

*Twenty-ninth* Day of *July 1986*

[SEAL]

*Attest:*

DONALD J. QUIGG

*Attesting Officer*

*Commissioner of Patents and Trademarks*